US007708052B2

(12) United States Patent
Leman et al.

(10) Patent No.: US 7,708,052 B2
(45) Date of Patent: May 4, 2010

(54) COIL SUPPORT

(75) Inventors: Derek A. Leman, Brownsburg, IN (US); Christopher J. Ingermann, Muncie, IN (US); Loren D. Hoffman, Indianapolis, IN (US); Frank J. David, Avon, IN (US); John A. Wade, Greenwood, IN (US); Larry D. Burns, Avon, IN (US); Nancy O. Ashcraft, Carmel, IN (US); Brian L. DePerro, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 688 days.

(21) Appl. No.: 11/336,650

(22) Filed: Jan. 20, 2006

(65) Prior Publication Data

US 2007/0169925 A1 Jul. 26, 2007

(51) Int. Cl.
*F28F 7/00* (2006.01)
*F21D 21/14* (2006.01)

(52) U.S. Cl. ..... 165/78; 62/285; 62/288; 62/291

(58) Field of Classification Search ..... 165/76, 165/78, 163; 62/285, 288, 291; 220/571, 220/572, 573; D23/354, 386
See application file for complete search history.

(56) References Cited

U.S. PATENT DOCUMENTS

| | | | | | |
|---|---|---|---|---|---|
| 4,687,604 | A * | 8/1987 | Goettl | 62/291 |
| 4,748,827 | A | 6/1988 | Chang | |
| 4,856,672 | A * | 8/1989 | Sullivan | 220/571 |
| 5,174,467 | A * | 12/1992 | Sullivan | 220/571 |
| 5,205,472 | A * | 4/1993 | Sullivan | 220/571 |
| 5,207,074 | A * | 5/1993 | Cox et al. | 62/285 |
| 5,337,517 | A * | 8/1994 | Karthauser et al. | 47/71 |
| 5,392,944 | A * | 2/1995 | Jennings | 220/571 |
| 5,669,230 | A * | 9/1997 | Bruce et al. | 62/285 |
| 5,966,958 | A * | 10/1999 | Maynard | 62/285 |
| 6,405,552 | B1 | 6/2002 | Hubert et al. | |
| 6,478,083 | B1 * | 11/2002 | Nanba et al. | 62/285 |
| 6,978,909 | B2 * | 12/2005 | Goetzinger et al. | 220/571 |
| D562,963 | S * | 2/2008 | Cantolino | D23/386 |
| 7,430,877 | B2 * | 10/2008 | Davenport et al. | 62/285 |

* cited by examiner

*Primary Examiner*—Ljiljana (Lil) V Ciric
(74) *Attorney, Agent, or Firm*—Kinney & Lange, P.A.

(57) ABSTRACT

A coil support suitable for supporting a coil in a condensing unit includes a body and a protrusion extending from the body. The protrusion is configured to limit movement of the coil in at least one direction.

18 Claims, 5 Drawing Sheets

COIL SUPPORT

CROSS-REFERENCE TO RELATED APPLICATION(S)

None.

BACKGROUND

The present invention relates to a coil support. More particularly, the present invention relates to a coil support configured to support a coil and limit movement of the coil in at least one direction.

A split system heating and/or cooling system includes an outdoor unit, such as a condensing unit, and an indoor unit such as an evaporator unit. The condensing unit typically includes a protective cover (e.g., an inlet grill), a condenser coil, and a base pan for containing the condensing unit and receiving condensation that drips from the coil. The coil and base pan are disposed within the protective cover. During operation, condensation may accumulate on the coil, such as during a defrost cycle of the condensing unit. The condensation typically drips downward into the base pan.

A coil support is often used to lift the coil off the base pan, rather than resting the coil directly in the base pan. The coil support separates the coil from the base pan, and therefore, any condensation that collects in the base pan. By lifting the coil up off of the bottom of the base pan, the coil support helps prevent corrosion between the base pan and the coil. Furthermore, using a coil support provides room for condensation to drip away from the coil and into the base pan.

BRIEF SUMMARY

The present invention is a coil support suitable for supporting a coil in a condensing unit of a split system heating and/or cooling system. The coil support includes a surface configured to engage with the coil, and the surface includes a protrusion extending therefrom. The protrusion is configured to limit movement of the coil. In one embodiment, the protrusion is a wall, while in another embodiment, the surface of the coil support includes a plurality of protrusions configured to engage with the coil.

DETAILED DESCRIPTION

Figure 1:
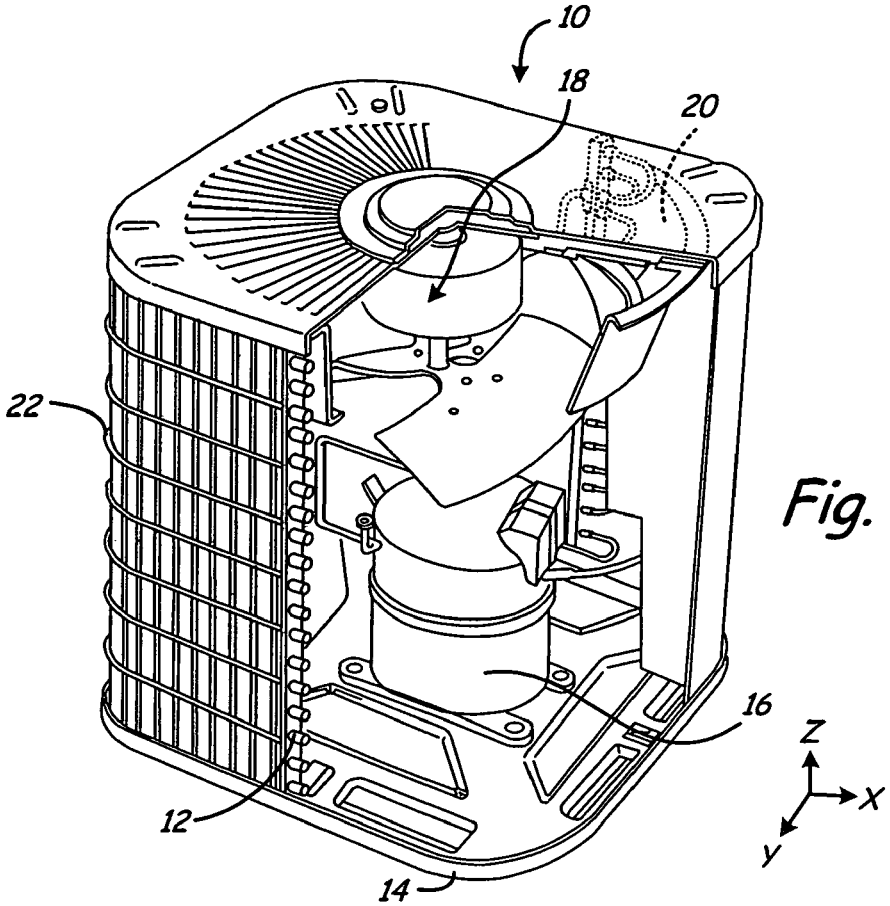
FIG. 1 is a perspective view of a condensing unit.

The present invention is a coil support suitable for use in a condensing unit to support a coil and limit movement of the coil. In particular, a surface of a coil support in accordance with the present invention includes at least one protrusion that limits and discourages movement of a coil. In one embodiment, the protrusion is a wall that is configured to act as a stop and limit movement of the coil in at least one direction (e.g., helping to prevent the coil from contacting a protective cover of the condensing unit). In another embodiment, a coil support includes a plurality of protrusions arranged in a matrix, where the protrusions are configured to engage with a coil to discourage movement of the coil in a generally horizontal direction (i.e., movement along the x-y plane, where orthogonal x-y-z coordinates are shown in FIG. 1). In yet another embodiment, a coil support includes a plurality of ribs configured to engage with the coil.

FIG. 1 is a perspective view of a general condensing unit 10 of an air conditioning or heat pump system. Condensing unit 10 is shown to aid in the description of the present invention and is not intended to limit the scope of the present invention. Condensing unit 10 includes condenser coil assembly 12, base pan 14, condenser 16, fan 18, and orifice assembly 20. Other components of condensing unit 10, such as a coil pad, have been removed from FIG. 1 for clarity of illustration. Coil assembly 12 is protected by inlet grill 22, which, together with base pan 14, also defines the shape of condensing unit 10. Although condensing unit 10 is shown in FIG. 1 to be generally square with rounded corners in cross-section, in alternate embodiments, condensing unit 10 may be any suitable cross-section, such as a circular or rectangular.

Coil assembly 12 is supported by a coil support (shown in FIG. 2) in accordance with the present invention, which is attached to base pan 14 using any suitable fastening mechanism, such as an adhesive, screw, or another mechanical attachment means. As discussed in the Background section, lifting coil assembly 12 off the bottom of base pan 14 helps prevent corrosion between coil assembly 12 and base pan 14, and provides room for condensation to drip away from coil assembly 12 and into base pan 14. The coil support will be discussed in further detail in reference to FIGS. 2-5.

When condensing unit 10 is used as a part of an air conditioning unit, fan 18 draws air from outside condensing unit 10 across coil assembly 12. Refrigerant is enclosed in piping that is used to form coil 15 (shown in FIG. 3) of coil assembly 12. As the refrigerant passes through coil 15 of coil assembly 12 and the cooler air from outside condensing unit 10 passes across coil assembly 12, the air absorbs heat from coil assembly 12, which causes the refrigerant to condense. Orifice assembly 20 is used to direct air out of condensing unit 10. The resulting liquid refrigerant then flows to an evaporator, which utilizes the refrigerant to cool air. As those skilled in the art recognize, when condensing unit 10 is used as a part of a heat pump system, coil assembly 12 acts as an evaporator coil to extract heat from the surrounding air.

It has been found that during the handling (e.g., shipping, installation, etc.) of condensing unit 10, coil assembly 12 of condensing unit 10 may shift, and damage may result. For example, coil assembly 12 may be pierced by a sharp edge of inlet grill 22 or by a screw that is used to assemble condensing unit 10. The operation of condensing unit 10 may be compromised if coil assembly 12 is damaged.

FIGS. 2-8 illustrate embodiments of a coil support in accordance with the present invention, where the coil support is configured to limit movement of coil assembly 12. In a first embodiment shown in FIGS. 2-4, a coil support includes a wall that limits movement of coil assembly 12 in at least one direction. The wall is positioned between coil assembly 12 and inlet grill 22 and acts as a stop to help prevent coil assembly 12 from contacting inlet grill 22. In some situations, the wall of the coil support also limits movement of coil assembly 12 the z-axis direction. In a second embodiment shown in FIG. 5, a coil support includes a wall and a plurality of protrusions configured to engage coil assembly 12. The protrusions help to discourage movement of coil assembly 12 along the x-y plane. In a third embodiment shown in FIG. 7, a coil support includes a plurality of protrusions (but no wall) that are configured to engage a coil assembly and help secure the coil assembly in a fixed position. In a fourth embodiment shown in FIG. 8, a coil support includes a wall and a plurality of ribs, which are configured to engage a coil assembly.

A coil support in accordance with the present invention may be formed of any suitable material, such as, but not limited to, a polymeric or a co-polymeric material.

Figure 2:
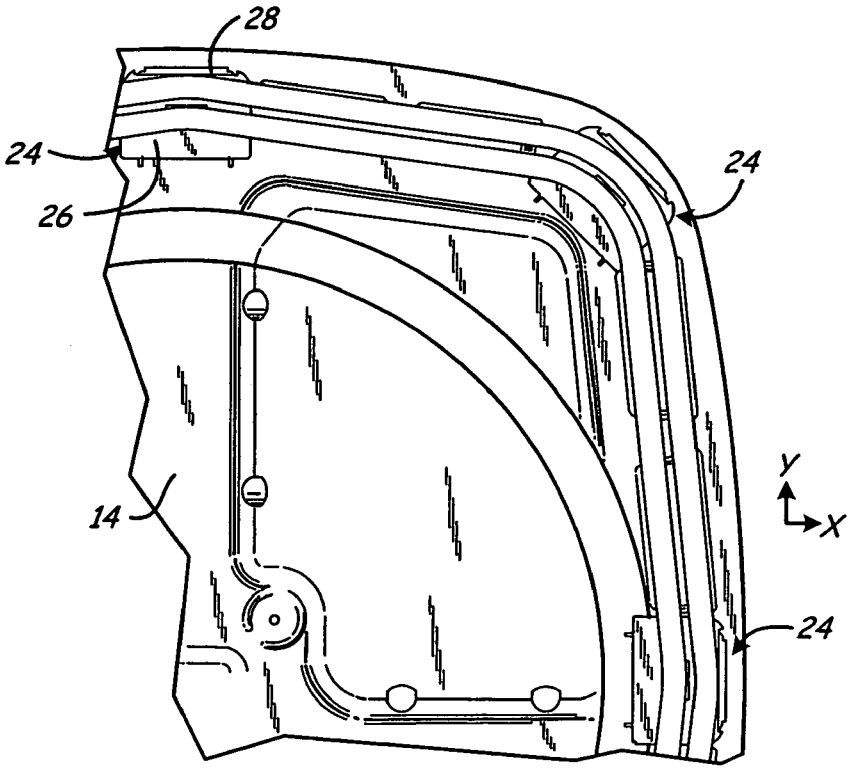
FIG. 2 is a plan view of a base pan and coil assembly, which is supported and separated from the base pan by a plurality of coil supports.

FIG. 2 is a plan view of base pan 14 and coil assembly 12, which is supported and separated from base pan 14 by a plurality of coil supports 24 in accordance with a first embodiment. Coil supports 24 are positioned about a perimeter of base pan 14. Each coil support 24 includes surface 26, which engages with coil assembly 12, and wall 28, which extends from surface 26.

Figure 3:
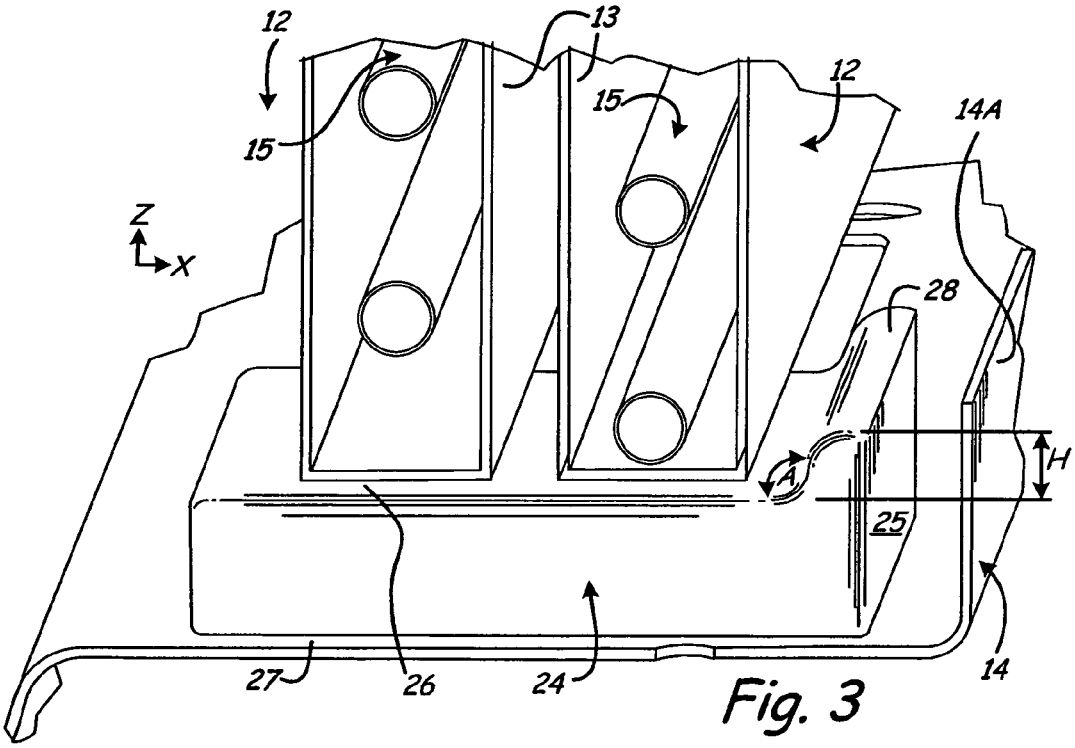
FIG. 3 is a plan view of the coil assembly, base pan, and coil support of FIG. 2.

FIG. 3 is a plan view of coil assembly 12, base pan 14, and coil support 24, and illustrates the relationship therebetween. Coil assembly 12 is engaged with surface 26 of coil support 24, while second surface 27 of coil support 24 is engaged with base pan 14. Second surface 27 of coil support 24 is positioned on an opposite side of coil support 24 from surface 26. As shown in FIG. 3, surfaces 26 and 27 are generally parallel to one another. However, in alternate embodiments, surface 26 and/or surface 27 may be sloped in order to help condensation move from surface 26 into base pan 14.

Coil assembly 12 is typically a part of a plate-fin coil assembly (or a "plate-fin coil"), which, as known in the art, is comprised of a serpentine shaped coil 15 extending between two parallel end plates (not shown) with a series of thin, parallel fins 13 mounted on coil 15. Fins 13 run along a vertical direction (i.e., the z-axis direction) and are oriented generally perpendicular to surface 26 of coil support 24. Fins 13 are commonly made of aluminum, and may be spaced apart from ⅛ inch to 3/32 inch. Fins 13 engage with surface 26 of coil support 24.

As FIG. 3 illustrates, wall 28 of each coil support 24 extends from and is generally perpendicular to surface 26. However, in alternate embodiments, wall 28 may be oriented at any suitable angle A less than 180° with respect to surface 26. Furthermore, wall 28 may be integral with surface 26.

A screw or other fastener may protrude through edge 14A of base pan 14 or through inlet grill 22 (shown in FIG. 1), which is adjacent to edge 14A of base pan, in order to secure base pan 14 and inlet grill 22 together. In order to help prevent the screw from puncturing coil 15 of coil assembly 12, wall 28 limits movement of coil assembly 12 in a direction toward side 25 of coil support 24. Otherwise stated, wall 28 acts as a stop that helps discourage/limit movement of coil assembly 12 toward edge 14A of base pan 14, as well as toward inlet grill 22.

Wall 28 also helps to discourage movement of coil assembly 12 when the movement also includes a z-direction component due to height H of wall 28. Height H may be adjusted, depending upon the amount of z-direction movement of coil assembly 12 that is to be restricted.

When multiple coil supports 24 are used, as shown in FIG. 2, a confined space is defined for coil assembly 12, thus further limiting movement of coil assembly 12. The confined space helps ensure coil assembly 12 will remain in place during handling of condensing unit 10. In an alternate embodiment, coil support 24 may also include a second wall on an opposite end of surface 26 from wall 28 to limit movement of coil assembly 12 away from edge 14A of base pan 14.

Figure 4:
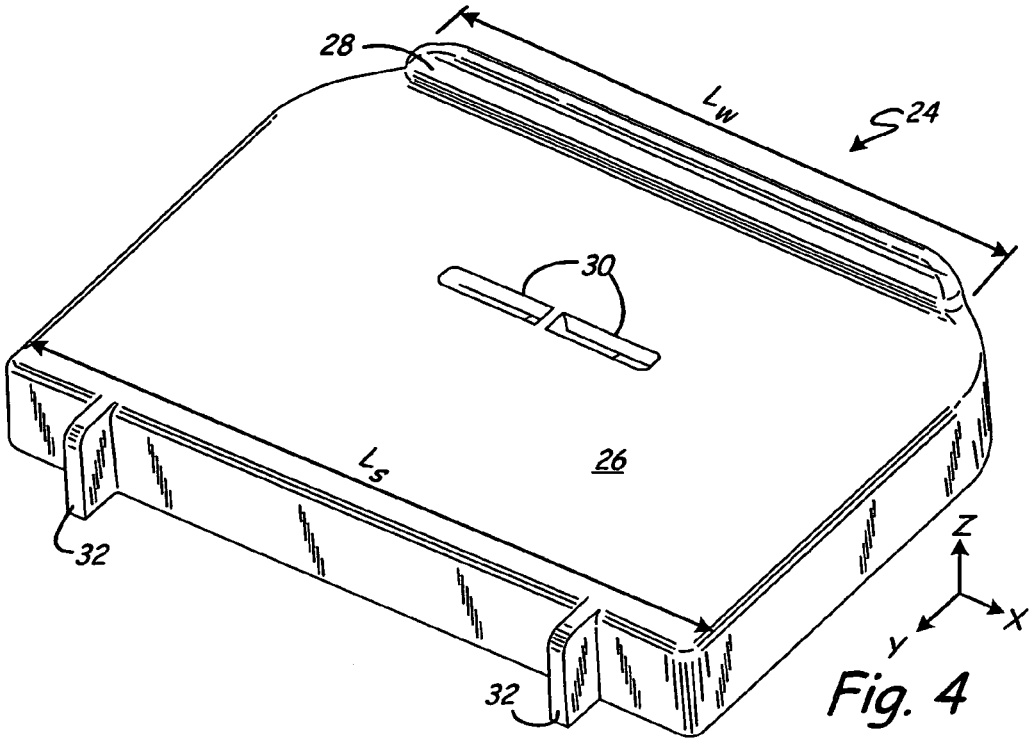
FIG. 4 is a perspective view of a first embodiment of a coil support, which includes a surface and a wall extending from the surface.

FIG. 4 is a perspective view of the first embodiment of coil support 24. Length $L_S$ of surface 26 of coil support 24 is greater than length $L_W$ of wall 28. Alternatively, length $L_S$ may be equal to or less than $L_W$. Coil support 24 includes recesses 30 and lips 32 for securing coil support 24 to base pan 14. A fastener, such as a screw, may be threaded through recesses 30 and into base pan 14. Of course, if an adhesive is used to attach coil support 24 to base pan 14, coil support 24 may not include recesses 30. Furthermore, in an alternate embodiment, lips 32 may be eliminated from coil support 24.

Figure 5:
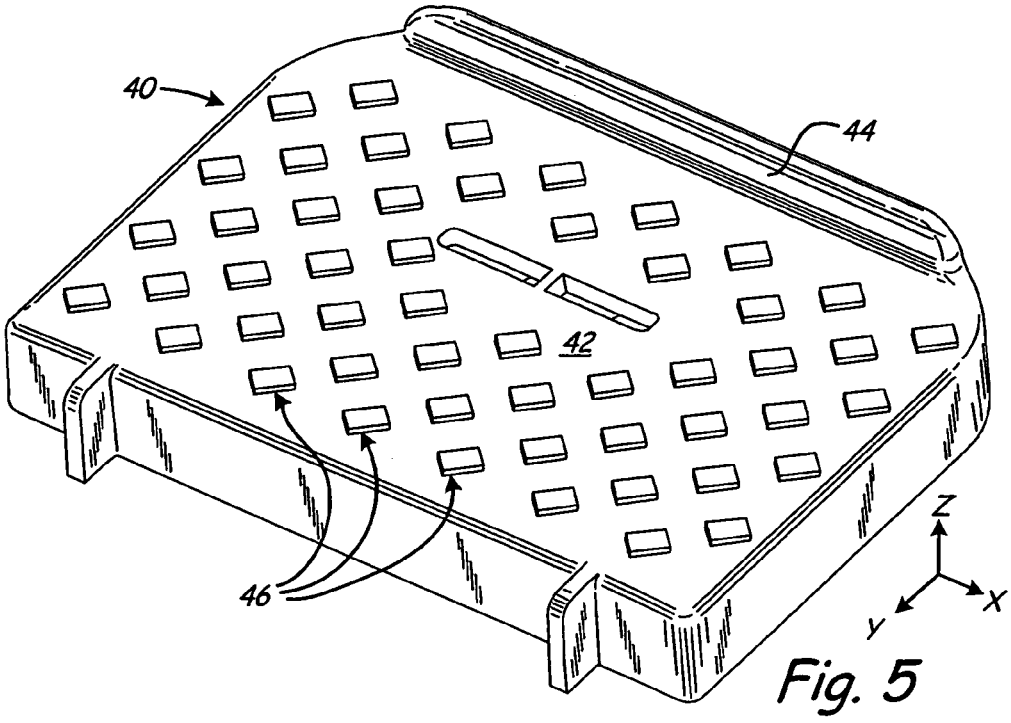
FIG. 5 is a perspective view of a second embodiment of a coil support, which includes a surface with a plurality of protrusions, and a wall extending from the surface.

FIG. 5 is a perspective view of a second embodiment of coil support 40, which includes surface 42, wall 44 extending from surface 42, and a plurality of protrusions 46 on surface 42. Coil support 40 is similar to coil support 24 of FIG. 4, except that surface 42 includes a plurality of diamond-shaped protrusions 46 that further aid in discouraging movement of coil assembly 12. Protrusions 46 are arranged in a matrix (i.e., a plurality of rows and columns). However, in alternate embodiments, protrusions 46 are arranged in another suitable pattern or in a random arrangement. In one embodiment, protrusions 46 are integral with surface 42, while in another embodiment, protrusions 46 are distinct units attached to surface 42.

Figure 6:
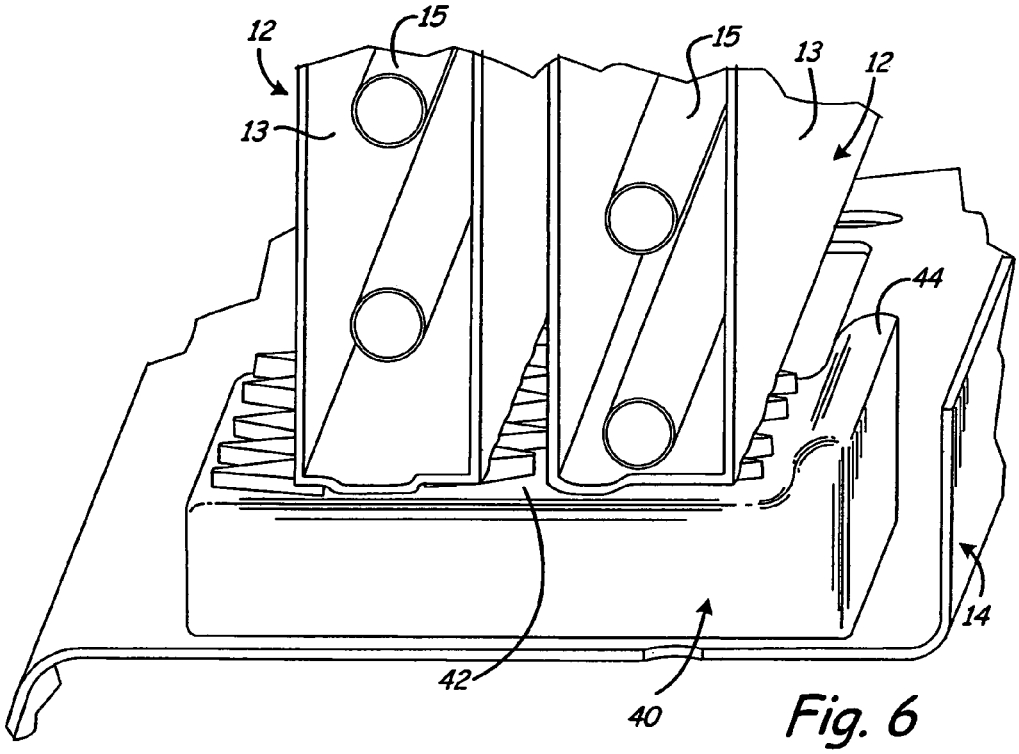
FIG. 6 is a plan view of the coil support of FIG. 5, where a coil assembly is engaged with the protrusions on the coil support.

FIG. 6 is a plan view of coil support 40 disposed in base pan 14, where coil assembly 12 is engaged with protrusions 46 on surface 42 of coil support 40. Fins 13 of coil assembly 12 are formed of a deformable material, such as aluminum. When coil assembly 12 is positioned on surface 42 of coil support 40, fins 13 engage with protrusions 46 on surface 42 and deform around protrusions 46. By interfacing with fins 13, protrusions 46 help discourage movement of coil assembly 12 along the x-y plane. Although FIG. 5 illustrates protrusions 46 having a diamond shape, protrusions 46 may be modified in alternate embodiments to be of any suitable shape.

Figure 7:
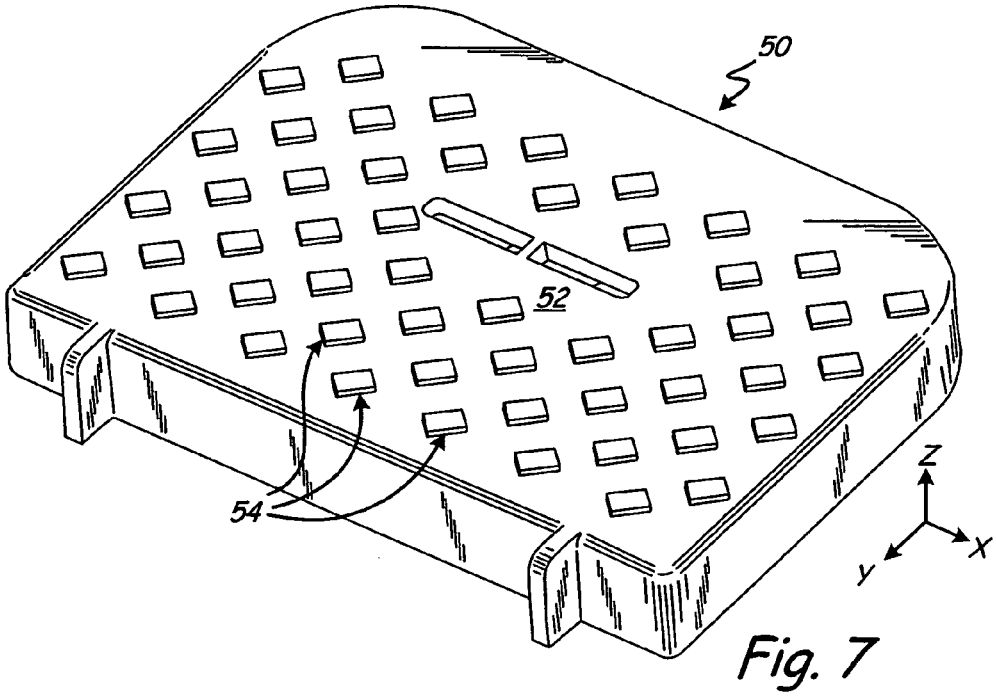
FIG. 7 is a perspective view of a third embodiment of a coil support, which includes a surface with a plurality of protrusions.

FIG. 7 illustrates a perspective view of a third embodiment of coil support 50, which is similar to coil support 40 of FIG. 5, except that coil support 50 does not include a wall extending from surface 52. Rather, as FIG. 7 shows, a plurality of protrusions 54 (which are similar to protrusions 46 of FIG. 4) on surface 52 of coil support discourage movement of coil assembly 12 generally along the x-y plane.

Figure 8:
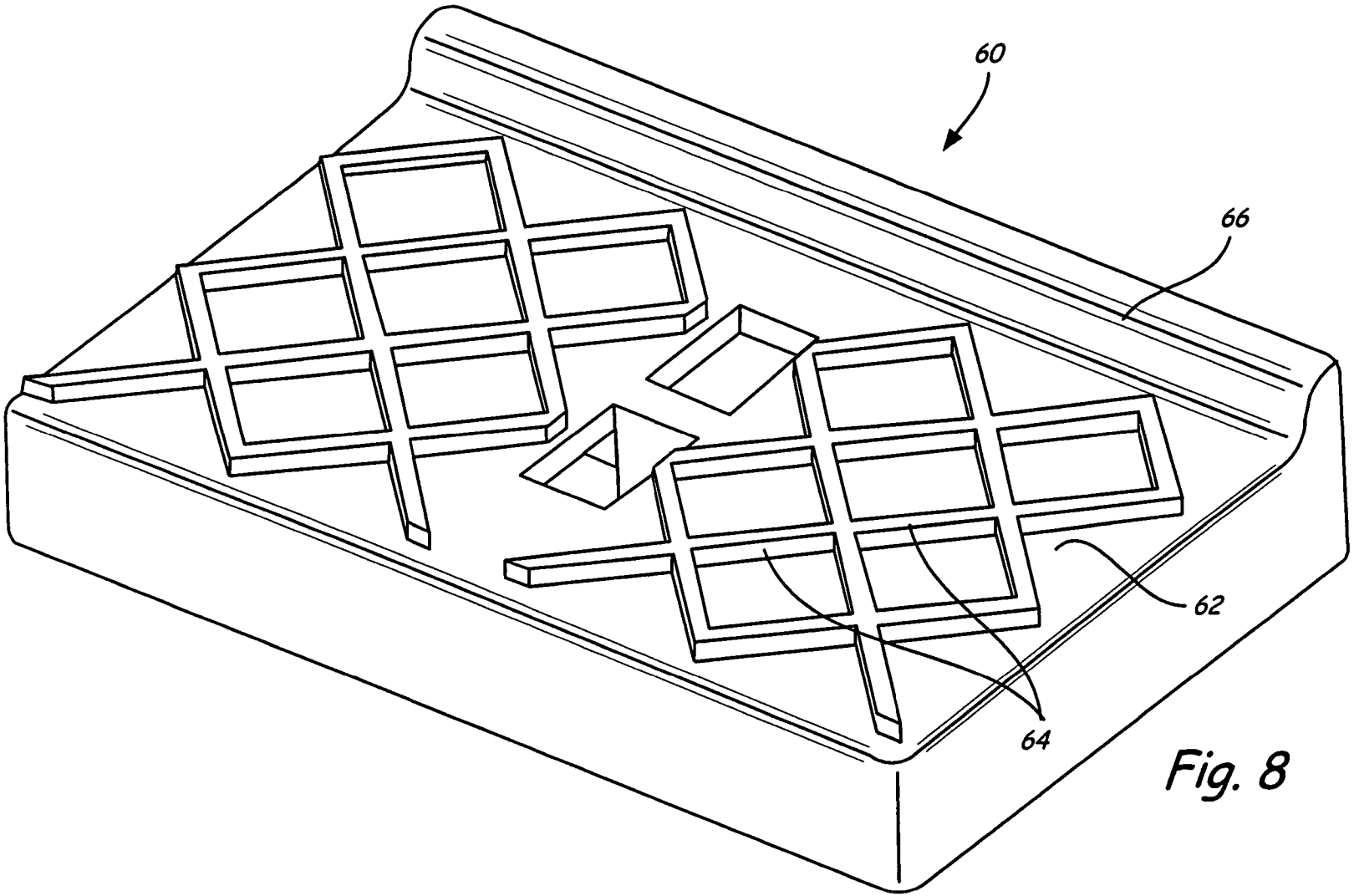
FIG. 8 is a perspective view of a fourth embodiment of a coil support, which includes a surface with a plurality of ribs.

FIG. 8 is a fourth embodiment of coil support 60 in accordance with the present invention, which includes surface 62, plurality of elongated ribs 64 extending from surface 62, and wall 66. In one embodiment, ribs 64 are integrally formed with surface 62, while in another embodiment, ribs 64 are attached to surface 62. Just as protrusions 46 (FIG. 6) are configured to engage with fins 13 of coil assembly 12, ribs 64 on surface 62 are configured to engage with coil assembly 12. When coil assembly 12 is positioned on surface 62, fins 13 deform around ribs 64 to discourage movement of coil assembly 12 in a generally horizontal direction. Coil support 60 may be modified to exclude wall 66, as well as change the pattern of ribs 64 on surface 62.

The terminology used herein is for the purpose of description, not limitation. Specific structural and functional details disclosed herein are not to be interpreted as limiting, but merely as bases for teaching one skilled in the art to variously employ the present invention. Although the present invention has been described with reference to preferred embodiments, workers skilled in the art will recognize that changes may be made in form and detail without departing from the spirit and scope of the invention.

The invention claimed is:

1. A coil support suitable for supporting a coil in a condensing unit, the coil support comprising:

a body comprising:

a platform configured to engage with the coil; and a sidewall extending downwards from the platform configured to engage with a base pan and elevate the platform above the base pan;

a plurality of discrete protrusions extending upwards from the body above the platform in a matrix; and a retaining wall extending upwards from one side of the body above the platform and the plurality of discrete protrusions, wherein the plurality of discrete protrusions and the retaining wall are configured to limit horizontal movement of the coil.

2. The coil support of claim 1, wherein the protrusions and the retaining wall extend in a generally perpendicular orientation from a top surface of the platform.

3. The coil support of claim 1, wherein the body, the retaining wall, and the protrusions are formed of a material selected from the group consisting of: a polymeric and a co-polymeric material.

4. The coil support of claim 1, wherein the protrusions are configured to engage with the coil to limit movement of the coil.

5. The coil support of claim 1, wherein the plurality of discrete protrusions are diamond shaped.

6. An apparatus for supporting a coil in a heating and/or air conditioning unit, the apparatus comprising:

a body including a platform configured to engage with the coil, and a sidewall extending downwards from the platform configured to engage with a base pan and elevate the platform above the base pan; and a plurality of discrete protrusions extending upwards from the body in a matrix, the protrusions extending above and being generally perpendicular to the platform and configured to limit horizontal movement of the coil.

7. The apparatus of claim 6, wherein apparatus is formed of a material selected from the group consisting of: a polymeric and a co-polymeric material.

8. The coil support of claim 6, wherein the plurality of discrete protrusions are diamond shaped.

9. The apparatus of claim 6, further comprising:

a retaining wall extending upwards from one side of the body above the platform and the discrete protrusions, wherein the plurality of discrete protrusions and the retaining wall are configured to limit horizontal movement of the coil.

10. A condensing unit comprising:

a cover including an interior surface;

a coil disposed within the cover;

a base pan connected to the cover and configured to receive condensation from the coil; and a plurality of coil supports disposed within the cover for supporting the coil in an elevated position above the base pan, each coil support comprising:

a platform engaged with a lower end of the coil and including a plurality of discrete protrusions arranged in a matrix and configured to limit horizontal movement of the coil toward the interior surface of the cover; and a sidewall extending downward from the platform engaging the base pan.

11. The condensing unit of claim 10, wherein at least part of the coil is deformed around the discrete protrusions to discourage movement of the coil assembly.

12. The condensing unit of claim 10, wherein the discrete protrusions of the coil support are integral with the platform of the coil support.

13. The condensing unit of claim 10, wherein coil support is formed of a material selected from the group consisting of: a polymeric and a co-polymeric material.

14. The condensing unit of claim 10, wherein the plurality of coil supports are spaced apart and positioned around a perimeter of the base pan.

15. The condensing unit of claim 10, wherein the plurality of discrete protrusions are diamond shaped.

16. The condensing unit of claim 10, wherein each of the plurality of coil supports further comprises:

a retaining wall extending upwards from one side of the body above the platform and the discrete protrusions, wherein the plurality of discrete protrusions and the retaining wall are configured to limit horizontal movement of the coil.

17. The condensing unit of claim 16, wherein the retaining wall is positioned between at least a part of the coil and the interior surface of the cover.

18. The condensing unit of claim 16, wherein the retaining wall of the coil support extends generally perpendicular from a top surface of the platform of the coil support.

* * * * *